US009010310B2

(12) United States Patent
Bockes et al.

(10) Patent No.: US 9,010,310 B2
(45) Date of Patent: Apr. 21, 2015

(54) INDEPENDENTLY SUPPORTED CONCRETE SAW APPARATUS AND METHOD

(71) Applicant: Heavy Equipment Manufacturing

(72) Inventors: Roger Bockes, Grundy Center, IA (US); Robert Bockes, Eldora, IA (US)

( * ) Notice: Subject to any disclaimer, the term of this patent is extended or adjusted under 35 U.S.C. 154(b) by 0 days.

(21) Appl. No.: 14/029,478

(22) Filed: Sep. 17, 2013

(65) Prior Publication Data

US 2014/0086683 A1 Mar. 27, 2014

Related U.S. Application Data

(63) Continuation-in-part of application No. 13/970,364, filed on Aug. 19, 2013, now abandoned, which is a continuation-in-part of application No. 12/956,051, filed on Nov. 30, 2010, now abandoned.

(60) Provisional application No. 61/265,232, filed on Nov. 30, 2009.

(51) Int. Cl.

| | |
|---|---|
| ***B28D 1/04*** | (2006.01) |
| ***E01C 23/02*** | (2006.01) |
| ***E01C 23/09*** | (2006.01) |
| *E01C 19/00* | (2006.01) |

(52) U.S. Cl.

CPC ..... *E01C 23/025* (2013.01); *E01C 19/004* (2013.01); *E01C 23/0933* (2013.01)

(58) Field of Classification Search

CPC ..... B28D 1/045; B28D 5/0082; B28D 5/045; E01C 23/166; E01C 23/18; E01C 23/22

USPC ..... 125/12, 13.03, 13.01; 451/69, 70, 461; 404/72, 75, 89, 74, 93, 94, 105, 87; 299/39.3; 249/2

See application file for complete search history.

(56) References Cited

U.S. PATENT DOCUMENTS

| | | | | | |
|---|---|---|---|---|---|
| 1,392,161 | A | * | 9/1921 | Hilts | 404/89 |
| 1,980,523 | A | * | 11/1934 | Heltzel | 404/89 |
| 2,546,308 | A | * | 3/1951 | Kahler | 156/575 |
| 2,935,981 | A | * | 5/1960 | Middlestadt | 299/39.3 |
| 3,257,917 | A | * | 6/1966 | Lewis | 404/105 |
| 3,291,532 | A | * | 12/1966 | Hatcher | 299/39.3 |
| 3,381,595 | A | * | 5/1968 | Hanson | 404/89 |
| 3,409,330 | A | * | 11/1968 | Hatcher et al. | 299/39.4 |
| 3,416,415 | A | * | 12/1968 | Worson | 404/74 |
| 3,779,609 | A | * | 12/1973 | James | 299/39.3 |
| 3,796,462 | A | * | 3/1974 | Staab | 299/1.5 |
| 3,874,806 | A | * | 4/1975 | Grist et al. | 404/93 |
| 3,887,294 | A | * | 6/1975 | Leon | 404/89 |
| 3,901,553 | A | * | 8/1975 | Binger et al. | 299/39.3 |
| 4,186,968 | A | * | 2/1980 | Barton | 299/39.2 |

(Continued)

*Primary Examiner* — George Nguyen
(74) *Attorney, Agent, or Firm* — Mitchell Law PLLC; Matthew W. Mitchell

(57) ABSTRACT

A saw apparatus for sawing paving slabs has a frame mounted on a ground contacting propulsion member such that the frame may move above a slab to be cut without touching the slab. A first saw support assembly disposes a blade of a saw in cutting engagement with the slab for a transverse cut. A second saw support assembly disposes a blade of another saw in cutting engagement with the slab for a longitudinal cut. The saws are mounted on the saw assemblies and the saw assemblies are mounted on the frame and the frame is mounted on the ground contact propulsion members such that no part of said frame need contact the slab during cutting.

16 Claims, 9 Drawing Sheets

(56) References Cited

U.S. PATENT DOCUMENTS

| | | | | |
|---|---|---|---|---|
| 4,197,032 | A * | 4/1980 | Miller | 404/98 |
| 4,762,371 | A * | 8/1988 | Lupton | 299/39.8 |
| 5,042,207 | A * | 8/1991 | Kirn | 451/342 |
| 5,135,287 | A * | 8/1992 | Karnes | 299/39.3 |
| 5,259,145 | A * | 11/1993 | Fushiya et al. | 451/342 |
| 5,464,365 | A * | 11/1995 | Kirn | 451/344 |
| 5,468,094 | A * | 11/1995 | Vanderpan et al. | 404/75 |
| 5,582,899 | A * | 12/1996 | Chiuminatta et al. | 428/167 |
| 5,921,228 | A * | 7/1999 | Watson | 125/13.01 |
| 6,715,957 | B2 * | 4/2004 | Colvard et al. | 404/105 |
| 6,872,028 | B2 * | 3/2005 | Aeschlimann et al. | 404/105 |
| 7,128,641 | B1 * | 10/2006 | Lin | 451/359 |
| 7,387,464 | B2 * | 6/2008 | Hall et al. | 404/94 |
| 7,387,465 | B2 * | 6/2008 | Hall et al. | 404/94 |
| 7,438,634 | B2 * | 10/2008 | Habele | 451/359 |
| 7,942,605 | B2 * | 5/2011 | Hall et al. | 404/94 |
| 7,972,199 | B2 * | 7/2011 | Blatz et al. | 451/359 |
| 8,365,715 | B2 * | 2/2013 | Toncelli | 125/35 |
| 2002/0017817 | A1 * | 2/2002 | Nakayama | 299/39.3 |
| 2002/0078941 | A1 * | 6/2002 | Pozzi et al. | 125/16.01 |
| 2003/0072612 | A1 * | 4/2003 | Colvard et al. | 404/105 |
| 2006/0157045 | A1 * | 7/2006 | Galambos et al. | 125/13.01 |
| 2010/0266339 | A1 * | 10/2010 | Guntert et al. | 404/105 |
| 2011/0194898 | A1 * | 8/2011 | Guntert et al. | 404/105 |
| 2011/0203565 | A1 * | 8/2011 | Hilsgen et al. | 125/13.03 |

* cited by examiner

INDEPENDENTLY SUPPORTED CONCRETE SAW APPARATUS AND METHOD

CROSS-REFERENCE TO RELATED APPLICATIONS

This application claims priority to and is a continuation-in-part application of U.S. application Ser. No. 13/970,364, filed Aug. 19, 2013, which in turn claims priority to and is a continuation-in-part application of U.S. application Ser. No. 12/956,051, filed Nov. 30, 2010, which in turn claims priority to U.S. Provisional Patent Application No. 61/265,232 filed Nov. 30, 2009, each of which is incorporated by reference herein in its entirety.

BACKGROUND OF THE INVENTION

1. Field of the Invention

The field of the present invention is in paving equipment.

2. Related Art

Poured concrete roadways are known to expand and contract in response to seasonal temperature variations. This expansion and contraction will cause uncontrolled cracking in random patterns that will disrupt the surface, provide a rough ride for vehicles traveling over the road and shorten the lifespan of the roadway. The traditional response has been to deliberately cut controlled expansion joints as slots in the roadway slab in order to provide room for expansion in a controlled fashion. These expansion joints in concrete roadways are cut in straight lines, have short metal dowel bars embedded in the concrete underneath them for strength and are typically sealed by a compressible yet waterproof material to keep ice from forming in the cracks. Usually the expansion joints are cut perpendicular to the direction of travel on the roadway, although angled variants are known.

During construction, there are frequent circumstances, for example, hot, windy conditions, when the contractor pouring a new roadway slab faces the possibility of the concrete drying quickly enough that uncontrolled cracking in random patterns on the surface of the slab may begin quickly, sometimes within the space of a few hours. A new slab for a roadway or a runway at an airport having uncontrolled cracking will not meet the specifications of the Department of Transportation or other authority responsible for the new paving. Accordingly, if such uncontrolled cracking appears in newly poured slab, contractor will be required to tear out the slab and start over.

Controlled expansion joint slots are cut into newly poured paving slabs by concrete saws. Concrete saws are comprised of a rotary disk having a cutting edge, a power supply such as an engine to turn the blade and a height adjustment apparatus. Prior art concrete saws, particularly those powerful enough for the paving industry, were heavy, sometimes up to a ton in weight. This weight was supported by wheels, typically four. The wheels on the prior art machines were small metal wheels in order to support the weight of the saw. The small size of the wheels consequently delivered a heavy loading factor to the surface of the slab being cut due to the small area of the wheels touching the slab surface. Accordingly, prior art saws could only work on slabs that were already dry. If the slab was not thoroughly dry, the weight of the concrete saw would cause the saw wheels to sink into the insufficiently dry slab surface, thereby creating unacceptable indentations in it. Hence prior art saws could not be used to cut expansion slots in slabs that were drying too quickly to avoid rapid cracking, because such slabs were still too wet to support the saw's weight.

It is also required that the concrete saws cut the expansion joints in the proper location, and to be as straight as possible. This is done in the prior art by chalk lines. The chalk line was followed by a guide arm on prior art concrete saws that would extend ahead of the rotating blade. A workman would physically move the entire saw as necessary to keep the guide arm on the chalk line. The expansion joint, once cut, was thereafter flushed to remove dust and other debris from it by air pressure, sand blasting or water flushing. The expansion joint was thereafter filled with a material such as silicon and/or caulk to seal it.

SUMMARY OF THE INVENTION

A saw apparatus for sawing paving slabs includes a frame; a ground contacting propulsion member; the frame being mounted on the ground contacting propulsion member such that the frame may move above a slab to be cut; a first saw support assembly having at least one first support member and at least a first saw mounted in connection with the first support member for linear motion of the saw along a width of a paving slab, the first saw support assembly having an engaged position and a removed position, the engaged position disposing a blade of the first saw in cutting engagement with a top surface of the slab; a second saw support assembly having at least one second support member and a second saw mounted in connection with the second support member for orientation of the second saw along a length of the slab, the second saw support assembly having an engaged position and a removed position, the engaged position disposing a blade of the second saw in cutting engagement along the length of the slab as the ground contacting propulsion member advances the saw apparatus along the slab; the first and second saws being mounted on the first and second saw assemblies, respectively, and the first and second saw assemblies being mounted on the frame and the frame being mounted on the ground contact propulsion member such that no part of the frame nor the ground contact propulsion member need contact the slab during cutting.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

Reference is now made more particularly to the drawings, which illustrate the best presently known mode of carrying out the invention and wherein similar reference characters indicate the same parts throughout the views.

DETAILED DESCRIPTION OF INVENTION

Figure 1:
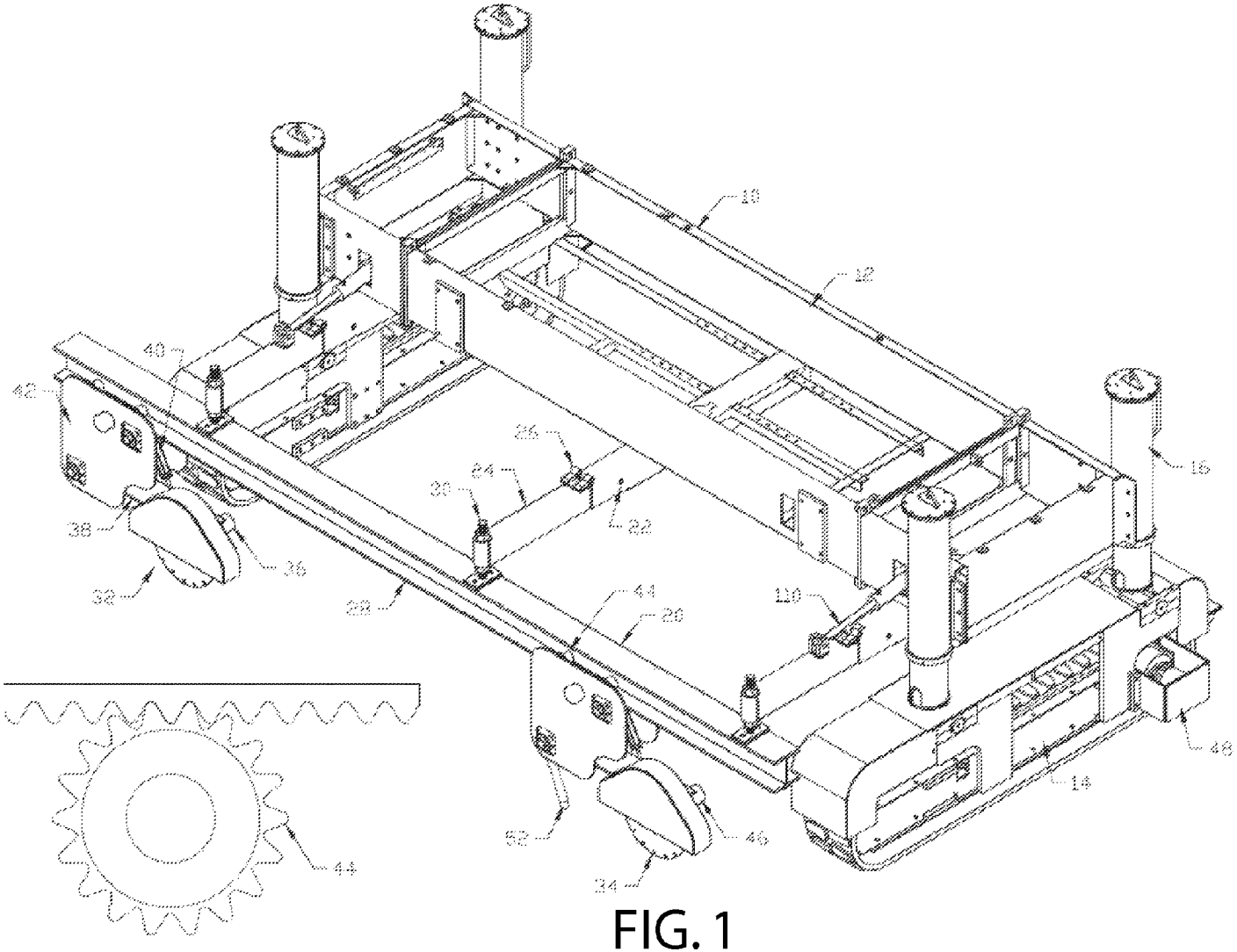
FIG. 1 is a perspective view of a concrete saw in an engaged position according to a first embodiment of the present invention.

In the following detailed description numerous specific details are set forth in order to provide a thorough understanding of the invention. However, it will be understood by those skilled in the art that the present invention may be practiced without these specific details. For example, the invention is not limited in scope to the particular type of industry application depicted in the figures. In other instances, well-known methods, procedures, and components have not been described in detail so as not to obscure the present invention.

A transverse frame 10 comprised of transverse frame beams 12 is provided for supporting the elements of the concrete saw. The entire apparatus is supported by ground contacting propulsion members, which in the depicted embodiment are a pair of tracks 14. Tracks 14 support the frame 10 in a position that does not contact the roadway slab being created. The tracks 14 are spaced sufficiently far apart so that the entire apparatus 10 straddles the roadway slab without the necessity of contacting it. The tracks of course may advance the frame 10 and the elements mounted on it along the length of the roadway in a continuous fashion without requiring disassembly and reassembly of the frame in each successive sawing location and without requiring other pieces of equipment to move the frame 10. Frame beams 12 may be unbolted and widened or shortened and re-assembled at the selected width in order to accommodate the dimension of the roadway to be paved before paving begins. Alternatively, hydraulic slides may be used to adjust width. Frame 10 is supported by support elements 16 which, in the depicted embodiment, are substantially vertical telescoping hydraulic cylinders 16.

Saw support assembly 20 is comprised of fixed support members 22 which in the depicted embodiment are longitudinal beams, and moving support members 24, which in the depicted embodiment are also longitudinally extending beams. These are attached by hinges 26 in the depicted embodiment. Transverse beam 28 is supported by moving support members 24 and fixedly attached to them. In the depicted embodiment, the attachment of the transverse beam 28 to moving support members 24 may be with adjustable attachments 30 so that a user can set a preferred level of elevation for transverse beam 28 when it is to be deployed in an engaged position.

Mounted on transverse beam 28 is at least one concrete saw 32. The concrete saw 32 is comprised of a rotating disk 34 having a cutting edge. The rotating disk is mounted on an axle 36 which is in turn mounted on a saw support element 38 which may be raised and lowered to a user selected depth. Adjusting the depth of the cut in the depicted embodiment is achieved by adjusting the hydraulic height adjuster 40. The support element 38 and height adjuster 40 are pivotally mounted on a saw frame 42. Height adjustment may be controlled by an elevation wand 52, which may signal a movement of the saw above or below user selected thresholds for an acceptable height range.

Figure 3:
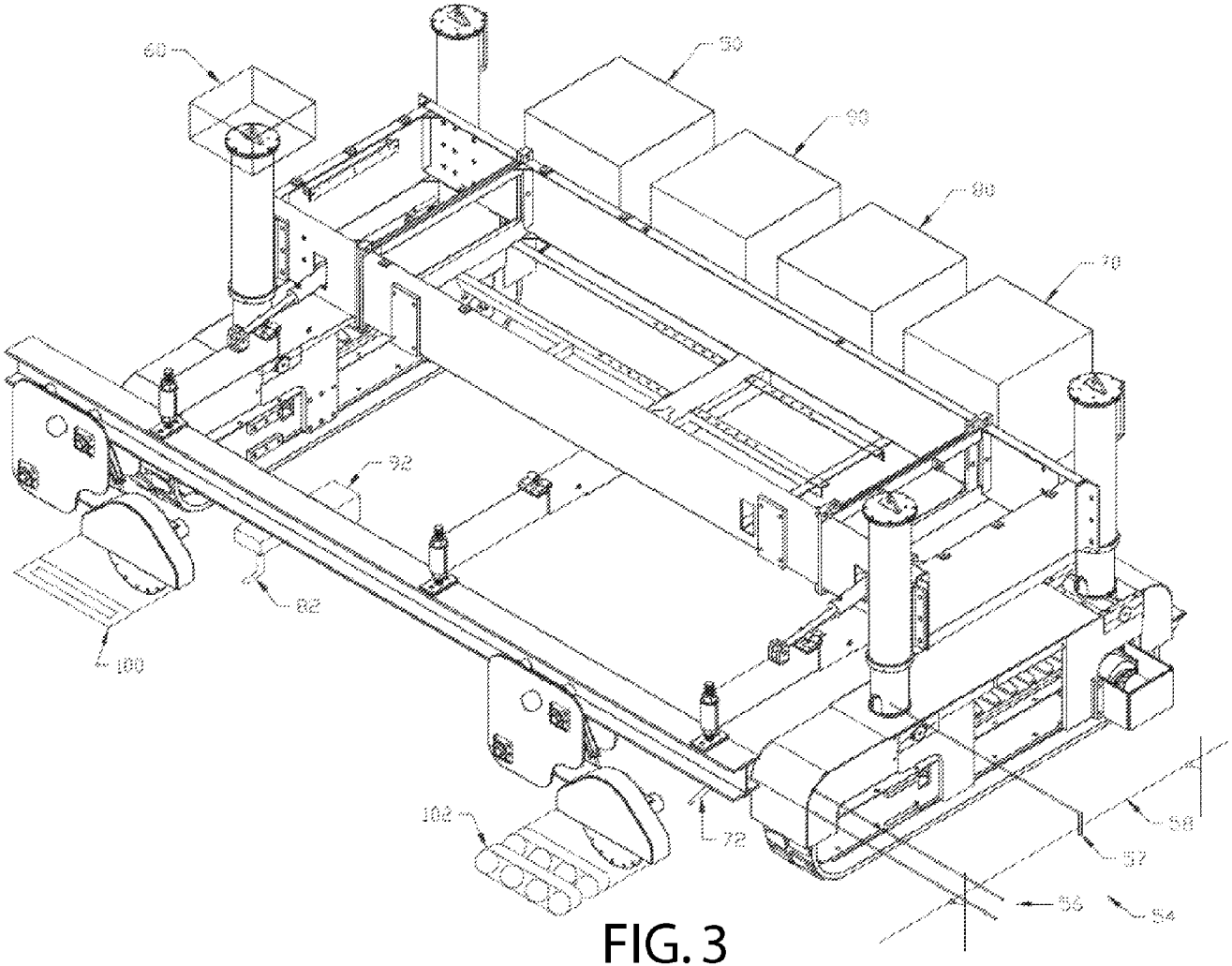
FIG. 3 is a perspective view of the concrete saw of FIG. 1.
Figure 4:
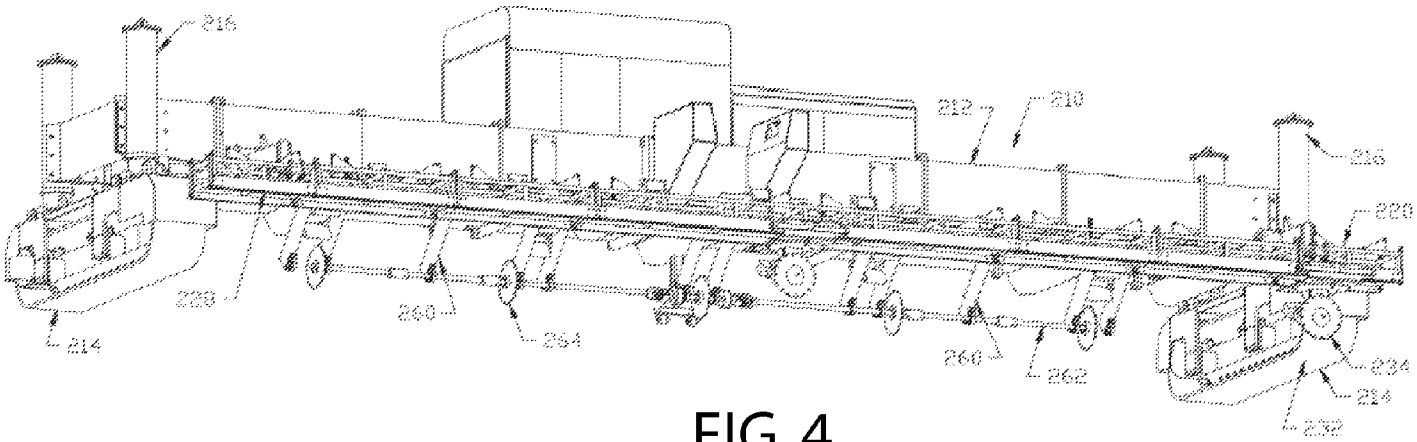
FIG. 4 is a front, bottom perspective view of a concrete saw according to a second embodiment.
Figure 5:
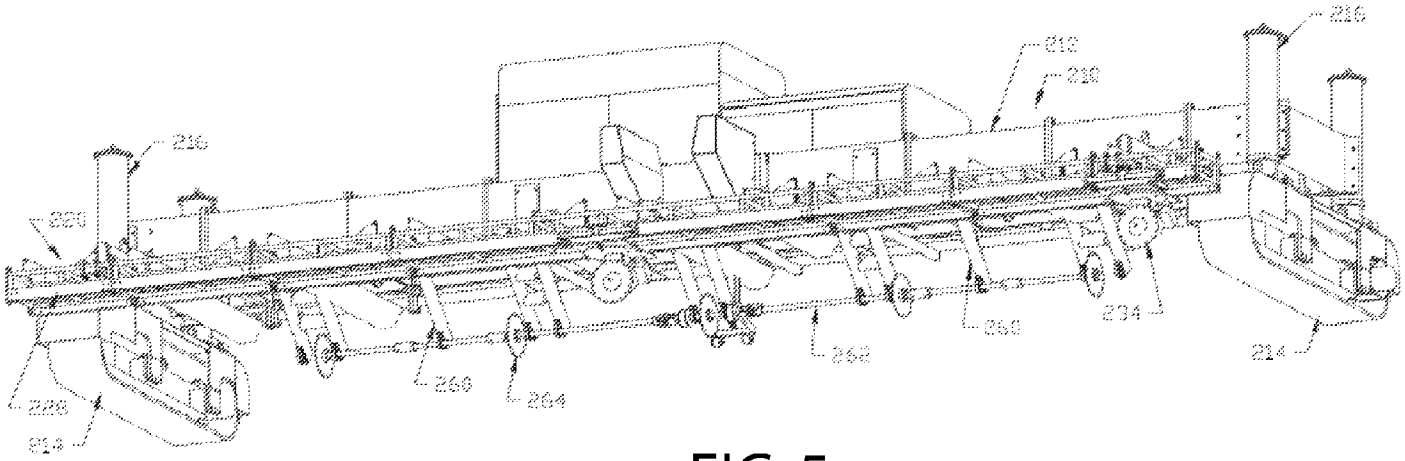
FIG. 5 is a front, bottom perspective view of the concrete saw from a different direction.
Figure 6:
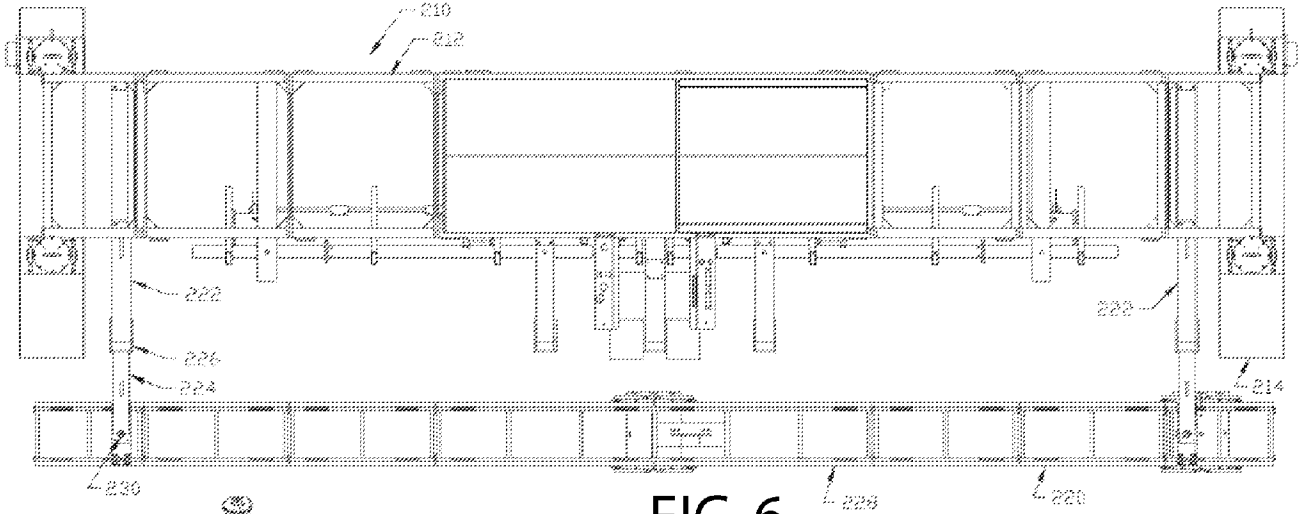
FIG. 6 is a top plan view of the concrete saw of FIGS. 4 and 5.
Figure 7:
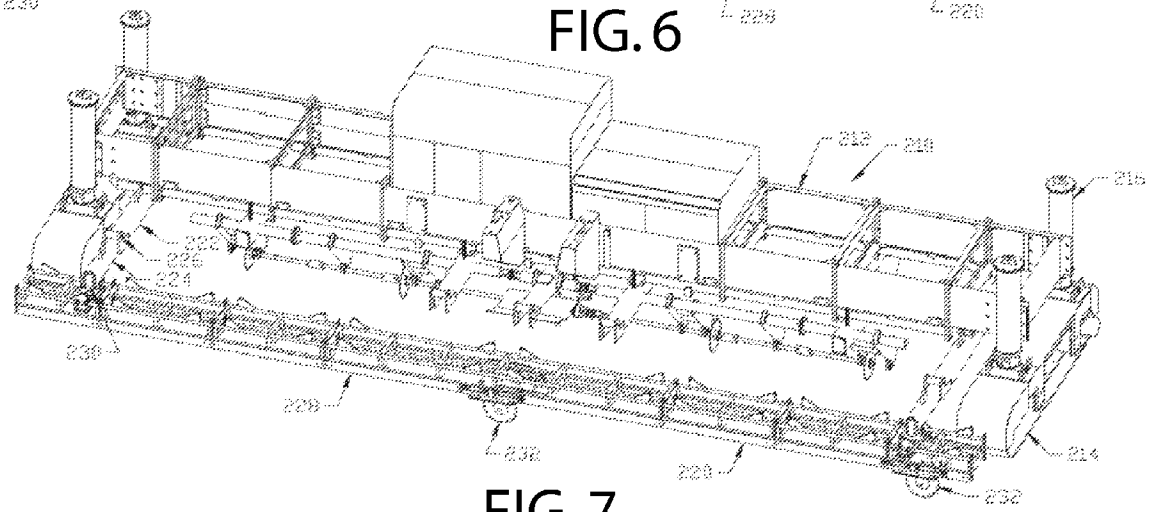
FIG. 7 is a top perspective view of the concrete saw of FIGS. 4-6.
Figure 8:
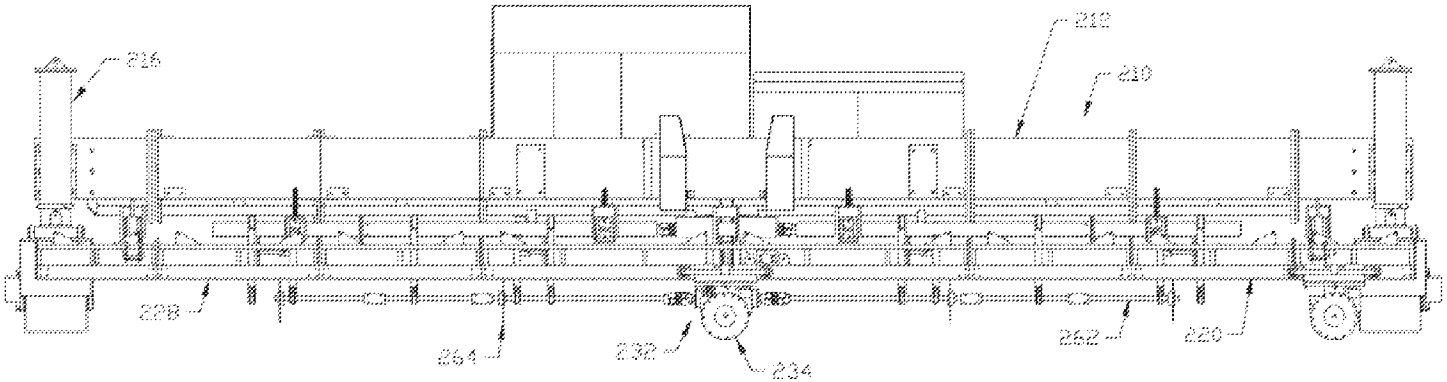
FIG. 8 is a front elevation view of the concrete saw of FIGS. 4-7.
Figure 9:
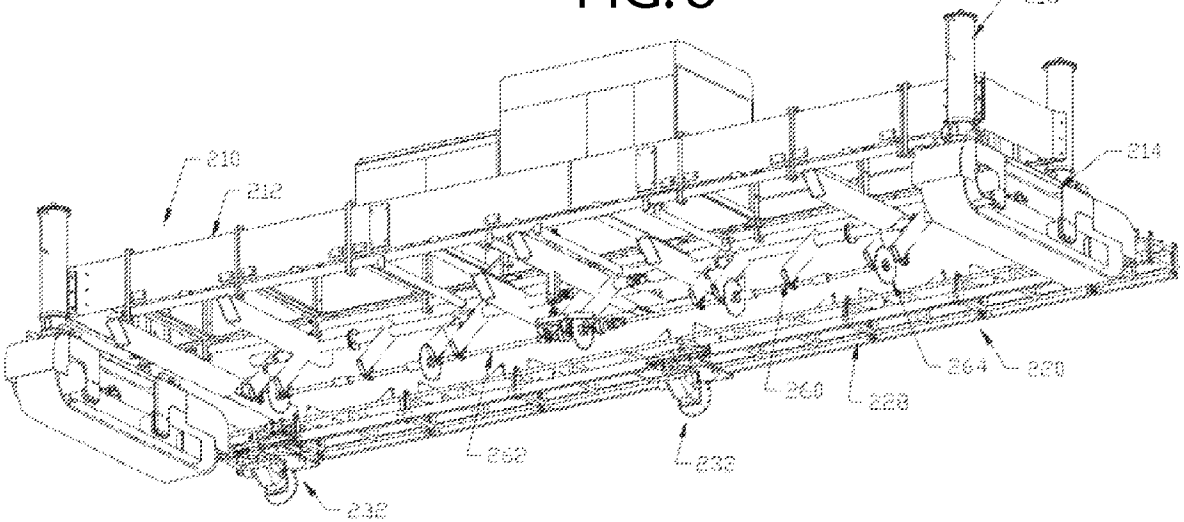
FIG. 9 is a rear, bottom perspective view of the concrete saw of FIGS. 4-8.
Figure 10:
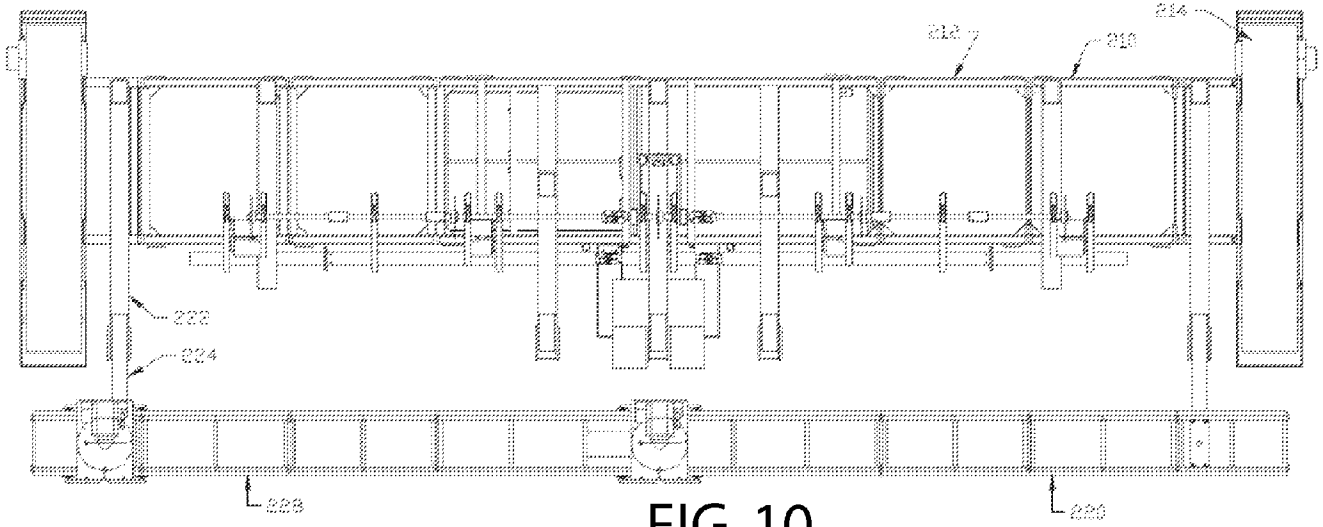
FIG. 10 is a bottom view of the concrete saw of FIGS. 4-9.
Figure 11:
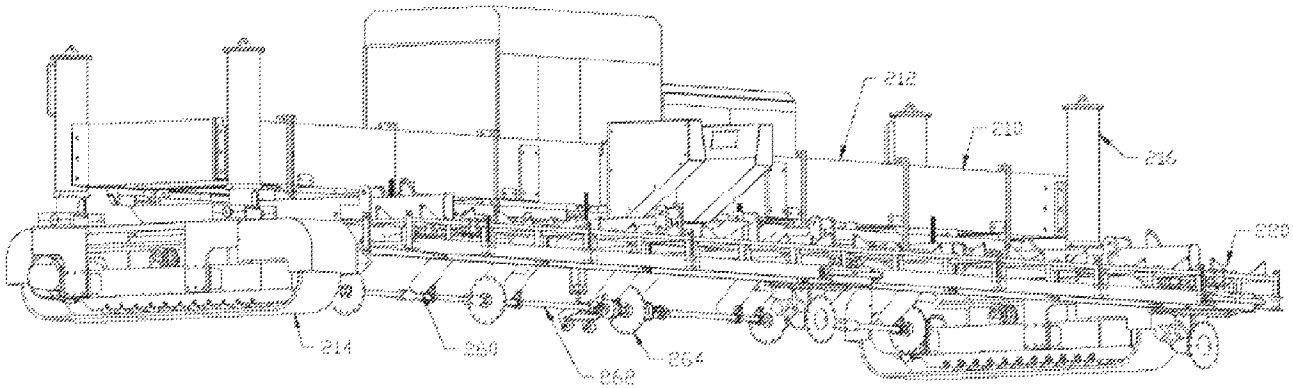
FIG. 11 is a ground-level perspective view of the concrete saw of FIGS. 4-10.
Figure 12:
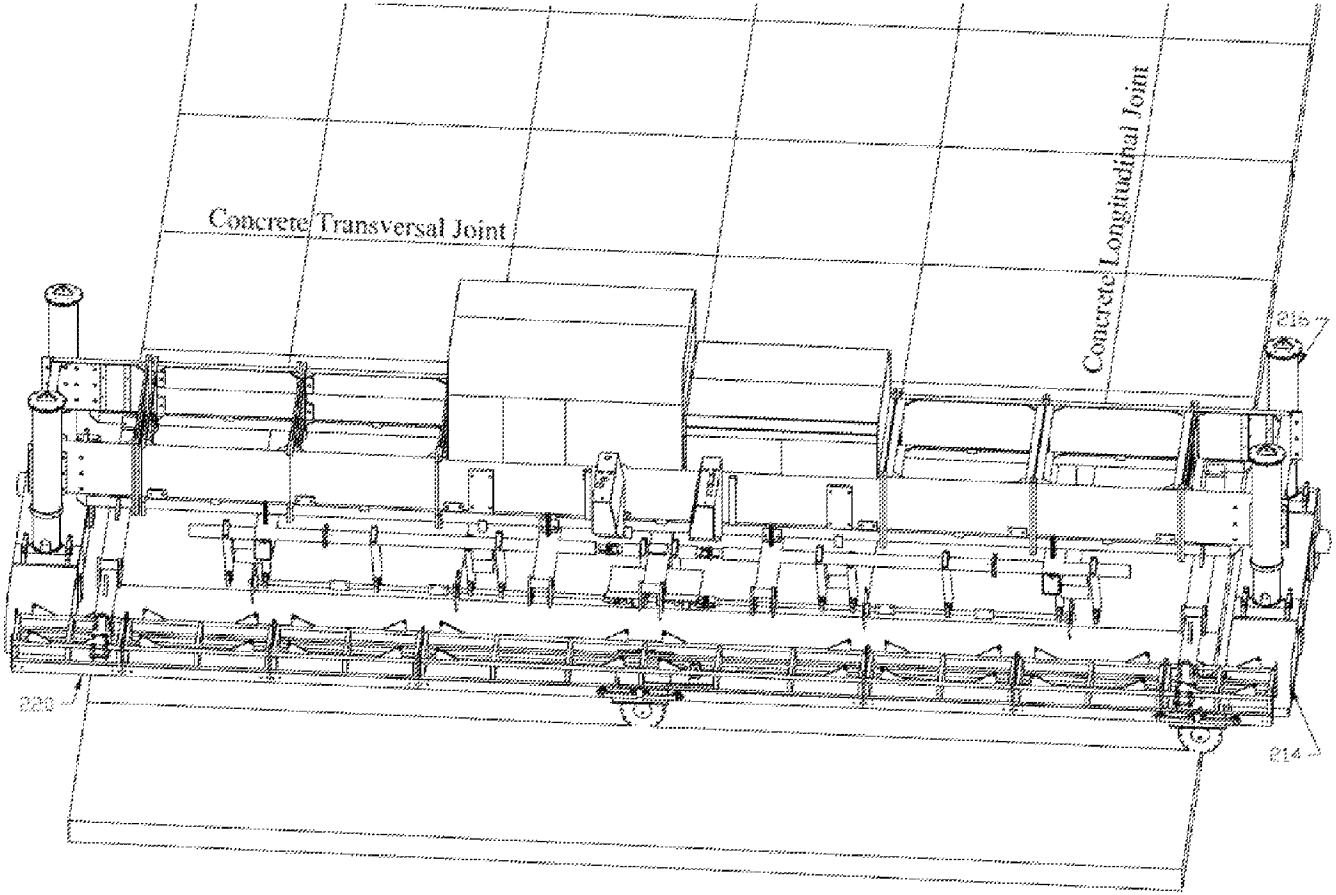
FIG. 12 is a top perspective view of the concrete saw showing the saw riding over a stretch of concrete and schematically illustrating the transverse and longitudinal joint cuts made by the saw.

The saw frame 42 is mounted on transverse beam 28 in a manner to allow for transverse travel of the saw assembly 32 along the transverse beam 28. In the depicted embodiment, travel is mediated by a rack and pinion assembly 44. The saw must be powered and, in the depicted embodiment, power is via a hydraulic motor 46. Hydraulic motors for the saws 46 and other hydraulic motors 48 powering the tracks are powered by an engine 50 (FIG. 3). Two saws 32 may be mounted on the transverse beam 28 to further speed cutting, and/or to more accurately cut a crowned road.

A control system for the saw may include a servo controlled motor 46 to actuate translation. Saw speed may be controlled to respond to varying degrees of resistance encountered, as for example in response to the oil pressure in the hydraulic motor 46. Sawing speeds may be increased using the present invention, as the concrete may be less resistant due to the fact that it may be cut before it is entirely hardened. Spalling may be advantageously controlled for the same reason.

The saw may also have an anti-spalling device 100 used in conjunction with its cutting, which may be mounted with the saw. The depicted anti-spalling device 100 may be a template, or, alternatively a small track assembly 102. Either may be mounted on the saw assembly 32 or not.

Figure 2:
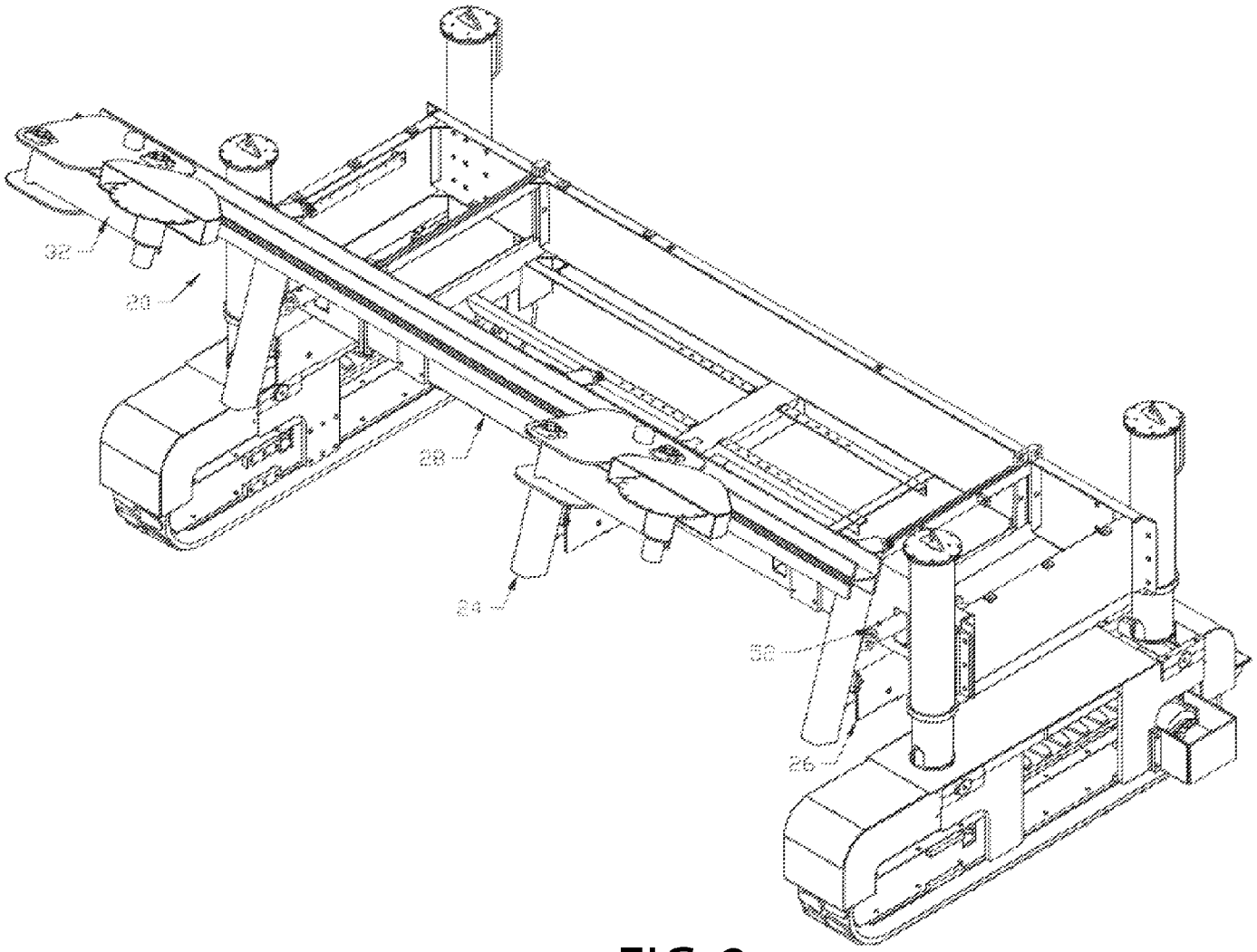
FIG. 2 is a perspective view of the concrete saw of FIG. 1 in a retracted position.

The entire saw engagement assembly 20, is movable between an engaged position, such as shown in FIG. 1, that places the rotating disk 34 in cutting engagement with the surface of a poured slab, without any other portion of the apparatus touching the slab. The saw engagement assembly 20 also has a retracted position, such as depicted in FIG. 2. In the depicted embodiment, retraction is achieved by rotating the moving supported elements 24 around hinges 26 such that the transverse beam 28 and saw assemblies 32 lift away from engagement with the slab. Retraction may be actuated as depicted by a telescoping member 110.

In an alternative embodiment, each moveable support arm 24 may be extendable in a longitudinal direction along the direction of travel of the paving machine. By extending one or more support arms 24 varying degrees, the slab may be cut at an angle non-perpendicular to the roadbed, which is required to meet some construction specifications.

The concrete saw apparatus may incorporate a guidance system, thereby advantageously avoiding the short comings of the chalk line system. These shortcomings include the difficulty in cutting a straight line at the end of each cut as the guide arm extends off the edge of the poured slab. The guidance system may be a guide string wand feeler or a laser non ground contact system.

The depicted wand guidance system 54 is mounted to the frame 10 and disposed to engage a guide string 58 previously placed to parallel and indicate the direction and proper elevation of the roadway on one or both sides. The wands 56 may extend horizontally to engage the string vertically, top and/or bottom, to guide elevation. The wands 57 may extend vertically to engage the string horizontally, on either or both sides, to guide direction. An alternatively depicted laser guidance system 60 may have receptors mounted on the frame and disposed to receive guiding laser signals from lasers placed in positions in the field preconfigured to guide elevation and direction.

Guidance systems are available to assist in the sometimes preferred practice of cutting expansion joint slots twice. This includes making a first pass to make a first narrower cut, and returning to that cut later with a second, wider saw blade to widen the cut. This practice controls the spalling characteristics of concrete, which vary over drying time. The retractability of the concrete saw support assembly 20 also facilitates this procedure which is advantageous in some circumstances.

The saw apparatus as depicted may be further deployed to advantageously execute other steps in the formation of expansion joints. This includes cooling the saw blade, which in the prior art was done by an extra worker hosing down the saw blade with water. In the depicted embodiment, a water reservoir 70 is provided, and a hose(s) 72 is disposed to spray cooling water on the saw blade. The hose 72 may be disposed to travel with the saw along the transverse beam 28.

The slot may be cleaned out by air pressure, water flushing or sand blasting, as selected by a user, with the use of the appropriate compressor 80, nozzle 82, and reservoir 70. The nozzle 82 may be disposed to travel along the transverse beam 28. In the alternative, the slot may be cleaned by vacuuming it out, in which case elements 80 and 82 may represent a vacuum and vacuum nozzle, respectively. The ability to immediately deploy a vacuum after applying cooling water or flushing water advantageously removes the resulting slurry of water and concrete dust, which is considered toxic in some circumstances.

Finally sealing equipment for injecting caulk, silicon, foam or other sealing material into the slot may be advantageously deployed on the frame, again with a reservoir 90 and injector 92. The injector 92 may be disposed to travel along the transverse beam 28.

FIGS. 4-13 illustrate a second, preferred embodiment. The embodiment of these figures is advantageously capable of executing longitudinal joint cuts in the concrete in addition to transverse cuts. This embodiment is similar in structure to the first embodiment described herein, and where reference is made to corresponding components, the same reference number with the addition of "2" will be used. A transverse frame 210 comprised of transverse frame beams 212 is provided for supporting the elements of the concrete saw. The entire apparatus is supported by ground contacting propulsion members, which in the depicted embodiment are a pair of tracks 214. Tracks 214 support the frame 210 in a position that does not contact the roadway slab being created. The tracks 214 are spaced sufficiently far apart so that the entire apparatus 210 straddles the roadway slab without the necessity of contacting it. The tracks of course may advance the frame 210 and the elements mounted on it along the length of the roadway in a continuous fashion without requiring disassembly and reassembly of the frame in each successive sawing location and without requiring other pieces of equipment to move the frame 210. Frame beams 212 may be unbolted and widened or shortened and re-assembled at the selected width in order to accommodate the dimension of the roadway to be paved before paving begins. Alternatively, hydraulic slides may be used to adjust width. Frame 210 is supported by support elements 216 which, in the depicted embodiment, are substantially vertical telescoping hydraulic cylinders 216.

Saw support assembly 220 is comprised of fixed support members 222 which in the depicted embodiment are longitudinal beams, and moving support members 224, which in the depicted embodiment are also longitudinally extending beams. These are attached by hinges 226 in the depicted embodiment. Transverse beam 228 is supported by moving support members 224 and fixedly attached to them. In the depicted embodiment, the attachment of the transverse beam 228 to moving support members 224 may be with adjustable attachments 230 so that a user can set a preferred level of elevation for transverse beam 228 when it is to be deployed in an engaged position.

Mounted on transverse beam 228 is at least one concrete saw 232. The concrete saw 232 is comprised of a rotating disk 234 having a cutting edge. The rotating disk is mounted on an axle which is in turn mounted on a saw support element which may be raised and lowered to a user selected depth. Adjusting the depth of the cut in the depicted embodiment is achieved by adjusting the hydraulic height adjuster. The support element and height adjuster are pivotally mounted on a saw frame.

The saw frame is mounted on transverse beam 228 in a manner to allow for transverse travel of the saw assembly 232 along the transverse beam 228. In the depicted embodiment, travel is mediated by a rack and pinion assembly. The saw must be powered and, in the depicted embodiment, power is via a hydraulic motor. Hydraulic motors for the saws and other hydraulic motors powering the tracks are powered by an engine. Two saws 232 may be mounted on the transverse beam 228 to further speed cutting, and/or to more accurately cut a crowned road.

This embodiment further incorporates a series of pivoting support members 260 extending downwardly and toward the rear of the saw. The pivoting support members are connected to and supported by a transverse beam 261 running along the width of the apparatus. In one version of this embodiment, these pivoting members carry an axle 262, which in turn supports and turns one or more longitudinally cutting saws 264. The longitudinally cutting saws 264 may be driven in a manner similar to the transverse cutting saw 232. The pivoting support members 260 are provided with a control mechanism to enable the support members 260 to be raised and lowered relative to the frame, by rotation of the transverse beam 261, to control engagement of the longitudinally cutting saws 264 with the surface of the concrete.

In an alternate and preferred version of this embodiment, each pivoting member 260 carries a longitudinally cutting saw 264. Each of the longitudinally cutting saws 264 is powered by a separate hydraulic motor such that each saw 264 may be turned on and off independently of the other saws 264. Each pivoting support member 260 is mounted on the transverse beam 261 by a clamp that may be selectively loosened to allow for horizontal positional adjustment of the support members 260, and hence the saws 264, along the length of the transverse beam 261 and then retightened to secure the support members 260 in position. This allows for selective adjustment of the positioning and separation of the saws 264 along the machine and, accordingly, of the resulting longitudinal cuts imparted to the concrete slab. The clamping mounting arrangement of the support members 260 also allows for vertical adjustment of the members 260 and, therefore, the saws 264.

Figure 13:
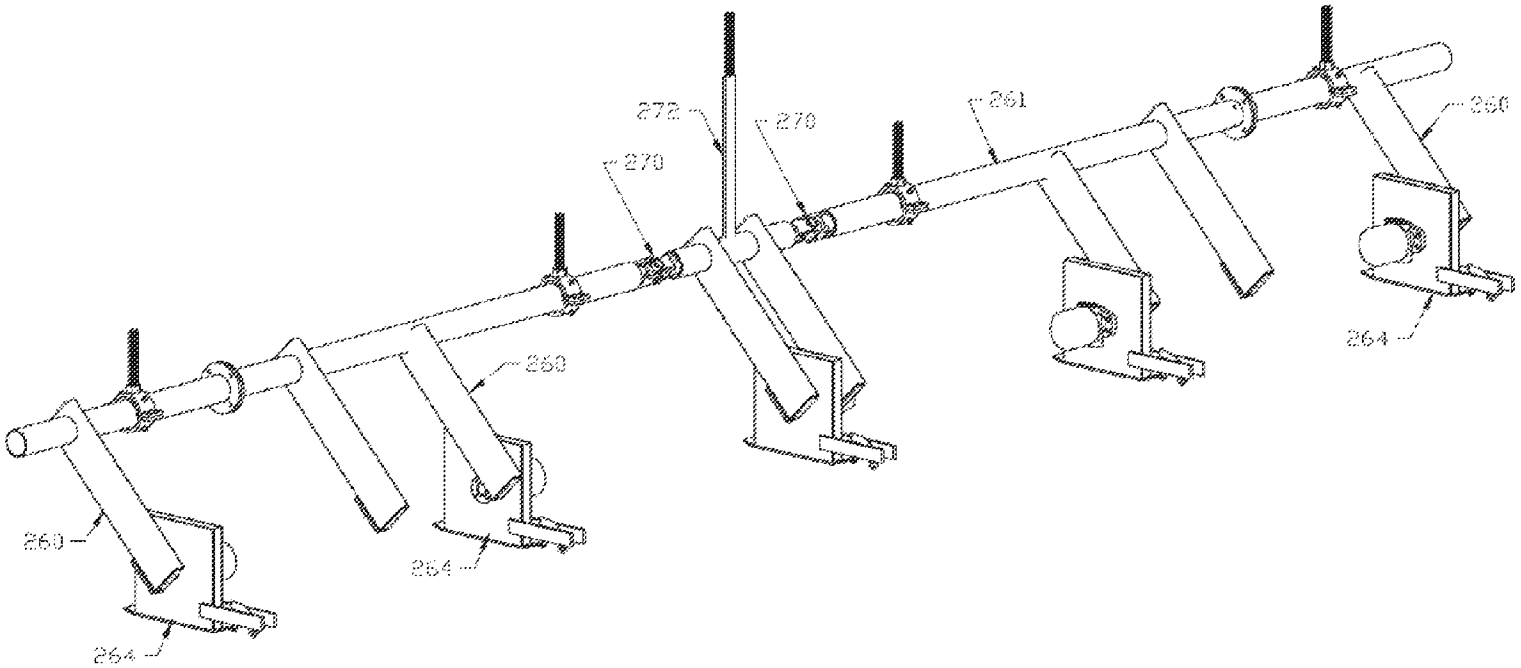
FIG. 13 is a perspective view isolating an longitudinal cutting saw arrangement in a preferred embodiment.

In a particularly preferred embodiment illustrated in FIG. 13, the transverse beam 261 is supported on the apparatus at each end and at the approximate center of the beam. Further, the beam is composed of two halves joined by a pivot at the approximate midpoint of the transverse beam 261 to the apparatus. In the illustrated embodiment, the pivot is composed of two pivoting joints 270 located on either side of a short center section of beam. This arrangement allows for a support member 260 and saw to be positioned at the midpoint of the transverse beam, which is commonly required location for a longitudinal joint in a slab, while still allowing the adjustment described below.

Advantageously, the midpoint of the transverse beam 261 is provided with a vertical adjustment cylinder 272 that raises and lowers the center of the transverse beam 261. At the same time, the two ends of the transverse beam 261 are held in a fixed vertical position relative to the apparatus, although the height of the beam ends may also be adjusted, for example in between operation of the apparatus. During operation, sensors determine variations in height of the concrete slab and, more particularly, the degree of crown present in the slab. In response to signals from these sensors, the midpoint of the transverse beam 261 is raised and lowered. If the ends of the transverse beam 261 are kept fixed, this adjustment of the midpoint of the beam 261 introduces a gradation in the height of the saws 264 along its length: lower at the ends and higher as the center point of the beam 261 is approached. This generally matches the positioning of the saws relative to the crown of the concrete slab. Alternately, if the slab is generally flat with no crown, the transverse beam 261 will be placed into a generally flat and level condition along its entire length.

It can therefore be seen that this embodiment is capable of executing, in a sequential manner, both longitudinal and transverse cuts in a concrete surface, and adjusting for various degrees of crowning along the surface, without the need for multiple machines and without contacting the concrete surface, except for the saws, to avoid marring the surface prior to complete curing.

In operation, a slab pour operation is set up with a roadbed, guidance system and paver provided. The saw of the present invention follows the paver along and over a poured slab by propelling itself on its tracks and supporting itself by ground contact only, without touching the slab. The saw is advanced to a preconfigured position for an expansion joint slot and the saw support assembly is moved from its retracted position to an engaged position with only the saw blade 34 contacting the surface of the slab. Sawing begins and proceeds to a user selected depth. The saw(s) move across the slab by translating along transverse beam 28. Supplementary procedures such as cooling the saw with water and flushing the slot may be done. When the slot is completely cut, the saw support assembly is retracted, the entire apparatus travels down the roadway as guided to the next preconfigured position for a slot to be cut and the process repeats. The apparatus may be returned to the slot positions for further supplemental procedures such as making a widening cut, flushing the slot or sealing it. It is within the scope of the present invention that the saw may be used to cut concrete, and also other paving materials.

In the case of embodiments provided with longitudinally cutting saws, the procedure is similar, however, the longitudinal expansion joint slots are cut as the saw advances on its tracks. Since the saw generally moves while creating longitudinal slots and remains in a single position while transverse slots are cut, these two operations will generally be carried out sequentially rather than simultaneously.

As various modifications could be made to the exemplary embodiments, as described above with reference to the corresponding illustrations, without departing from the scope of the invention, it is intended that all matter contained in the foregoing description and shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

What is claimed is:

1. A saw apparatus for sawing paving slabs, said paving slabs having a length and a width with said length being substantially greater than said width comprising:

a frame;

a ground contacting propulsion member;

said frame being mounted on said ground contacting propulsion member such that said frame may move above a slab to be cut;

a first saw support assembly having at least one first support member and at least a first saw mounted in connection with said first support member for linear motion of said saw along said width of said paving slabs, said first saw support assembly having an engaged position and a removed position, said engaged position disposing a blade of said first saw in cutting engagement with a top surface of said paving slabs;

a second saw support assembly having at least one second support member and a second saw mounted in connection with said second support member for orientation of said second saw along said length of said paving slabs, said second saw support assembly having an engaged position and a removed position, said engaged position disposing a blade of said second saw in cutting engagement along said length of said top surface of said paving slabs as said ground contacting propulsion member advances said saw apparatus along said length of said paving slabs;

said first and second saws being mounted on said first and second saw assemblies, respectively, and said first and second saw assemblies being mounted on said frame and said frame being mounted on said ground contact propulsion member such that no part of said frame nor said ground contact propulsion member need contact the slab during cutting.

2. The saw apparatus of claim 1, further comprising said first and second saws each being a concrete saw.

3. The saw apparatus of claim 1, wherein said group contact propulsion member further comprises at least one track.

4. The saw apparatus of claim 1, further comprising an axle supported by said second support assembly, said axle in turn supporting said second saw.

5. The saw apparatus of claim 4, wherein said axle is operable for driving said second saw.

6. The saw apparatus of claim 4, said axle supporting at least a third saw at a distance from said second saw.

7. The saw of claim 6, wherein said axle is operable for simultaneously driving both said second saw and said third saw.

8. The saw apparatus of claim 1, wherein said second support assembly further comprises at least first and second pivoting support members, said first pivoting support member supporting said second saw and said second pivoting support member supporting a third saw.

9. The saw apparatus of claim 8, further comprising a separate and independent power source for each of said second and third saws.

10. The saw apparatus of claim 8, further comprising a transverse beam connected with said frame and supporting said first and second pivoting support members.

11. The saw apparatus of claim 10, wherein said first and second pivoting support members are selectively rotationally and slidably connected to said transverse beam, each of said first and second pivoting support members therefore being operable for selective rotational and sliding movement relative to said transverse beam.

12. The saw apparatus of claim 10, further comprising first and second connections of a first and a second end of said transverse beam with said frame and a third connection of a midpoint of said transverse beam with said frame.

13. The saw apparatus of claim 12, wherein said midpoint of said transverse beam is provided with at least one pivoting connection and wherein said third connection further comprises a vertical adjustment mechanism.

14. The saw apparatus of claim 13, further comprises at least one sensor operable to determine a height of said paving slab at one or more points along its width and to generate a signal corresponding to said determined height and wherein said vertical adjustment mechanism is operable for receiving said signal and raising or lowering said midpoint of said transverse beam in response to said signal.

15. The saw apparatus of claim 1, further comprising vertical support elements supporting said frame on said ground contact propulsion member.

16. The saw apparatus of claim 15, wherein said vertical support elements further comprise vertical telescoping hydraulic cylinders.

* * * * *